US005732779A

United States Patent [19]

Palmatier

[11] Patent Number: 5,732,779

[45] Date of Patent: Mar. 31, 1998

[54] CHIMNEY-FIRE SAFETY SYSTEM

[76] Inventor: Jon Palmatier, 548 Brotzman Rd., Binghamton, N.Y. 13901

[21] Appl. No.: 646,205

[22] Filed: May 7, 1996

[51] Int. Cl.[6] ..... A62C 3/04

[52] U.S. Cl. ..... 169/57; 169/54

[58] Field of Search ..... 169/54, 57

[56] References Cited

U.S. PATENT DOCUMENTS

| | | | |
|---|---|---|---|
| 4,260,023 | 4/1981 | Irmscher | 169/54 X |
| 4,469,183 | 9/1984 | Hayes | 169/57 X |
| 5,163,516 | 11/1992 | Palmatier | 169/54 |

*Primary Examiner*—Andrew C. Pike
*Attorney, Agent, or Firm*—Salzman & Levy

[57] ABSTRACT

An improved chimney-fire safety device includes a cylindrical canister that is placed in the top of a chimney or a stovepipe. The canister contains a mesh basket which has one or more membranes that are filled with extinguishing compounds. The mesh basket and a protective insulation platform are retained in the canister during controllable fires. The basket is secured to the canister by a tether. A fuse cap located in a bottom portion of the canister retains the basket, but disintegrates at a temperature commensurate with that of a runaway fire. When the fuse cap disintegrates, the mesh basket containing the extinguishing compounds drops from the canister and becomes suspended over the fire due to the tether; thus, the extinguishing chemicals are dispersed to the fire in a controlled fashion.

10 Claims, 2 Drawing Sheets

CHIMNEY-FIRE SAFETY SYSTEM

FIELD OF THE INVENTION

The invention pertains to chimney-fire safety devices and, more particularly, to a dispersing mechanism for chemical compounds that are used in a chimney safety system which automatically extinguishes a chimney fire or a runaway fire caused by a wood-burning stove.

RELATED PATENT APPLICATION

This application presents an improvement in the safety system disclosed in U.S. Pat. No. 5,163,516, issued to the same inventor on Nov. 17, 1992. The teachings disclosed therein are hereby incorporated by reference.

BACKGROUND OF THE INVENTION

The aforementioned U.S. Pat. No. 5,163,516 describes a fire-fighting system for a chimney or a wood-burning-stove fire that is out of control. The fire-fighting system dumps chemical fire-extinguishing materials on an out-of-control chimney fire in sequential or multistage increments.

In theory, such dumping is a more efficient means of bringing these raging fires under control than is bulk application of the chemicals. The various compounds of the extinguisher of the aforementioned patent are encased and nested in a fusible, time-release membrane. The staged, incremental release of the chemicals brings the fire under control.

In practice, however, the staging of the extinguisher chemicals is not always uniformly accomplished. It has been discovered that, if the initial application of the chemicals extinguishes the fire, the remainder of the chemicals tend to drop quickly to the bottom of the chimney, without contributing at all to the control of the initial fire or subsequent flare-ups.

It would be advantageous to provide an additional improvement to the dispersing mechanism for ensuring the proper control and release of the fire-fighting compounds.

SUMMARY OF THE INVENTION

In accordance with the present invention, there is provided an improved chimney-fire safety device. The device includes a cylindrical canister that is affixed to the top of a chimney or stove pipe. An open mesh basket retained within the canister contains fire-fighting compounds and extinguishing chemicals. The basket is attached to the canister by a tether. The basket rests on a layer of insulation within the canister. The insulation protects the extinguishing chemicals from the heat of the flue gases. A fuse cap disposed in a bottom portion of the canister is designed to disintegrate when the flue gases reach a given temperature commensurate with that of a dangerous fire. When the fuse cap disintegrates, the basket and the insulation drop out of the canister. The basket containing the fire-fighting compounds becomes suspended over the fire due to the tether. The mesh size of the basket is designed to meter the flow of extinguishing chemicals being fed to the fire. A fine mesh provides a slower feed rate, whereas a coarser mesh supplies extinguishing materials at a faster rate. A 1½"×1½" to 2½"×2½" mesh is normally adequate for both mesh size extremes.

BRIEF DESCRIPTION OF THE DRAWINGS

A complete understanding of the present invention may be obtained by reference to the accompanying drawings, when considered in conjunction with the subsequent detailed description, in which.

For the sake of brevity and clarity, like elements will bear the same numerical designations throughout the FIGURES.

DESCRIPTION OF THE PREFERRED EMBODIMENT

Generally speaking, the invention features a fire-safety device for chimney or wood-burning-stove fires. A dangerous or runaway fire in a chimney or a wood-burning-stove flue is treated by extinguishing compounds contained within a canister. The canister is disposed in an upper portion of a chimney or a stovepipe. The fire-extinguishing compounds are held within the canister by a fuse cap disposed in the bottom of the canister. Heat from a runaway or uncontrolled fire causes the fuse cap to separate completely from the canister at its periphery, thus releasing the fire-fighting extinguishing compounds. The chemical extinguishing compounds are contained in an open mesh basket which rests on a layer of insulation designed to protect the extinguishing compounds from constant heat. Said basket is secured by a cable or chain to the top of the canister (not shown). When the fuse cap separates from the canister, the aforementioned basket or platform (attached by the chain or cable thereto) drops and becomes suspended in the upper portion of the flue. The open mesh basket allows the extinguishing compounds to disperse more slowly and evenly, thus ensuring that the fire will be brought under control.

Figure 1:
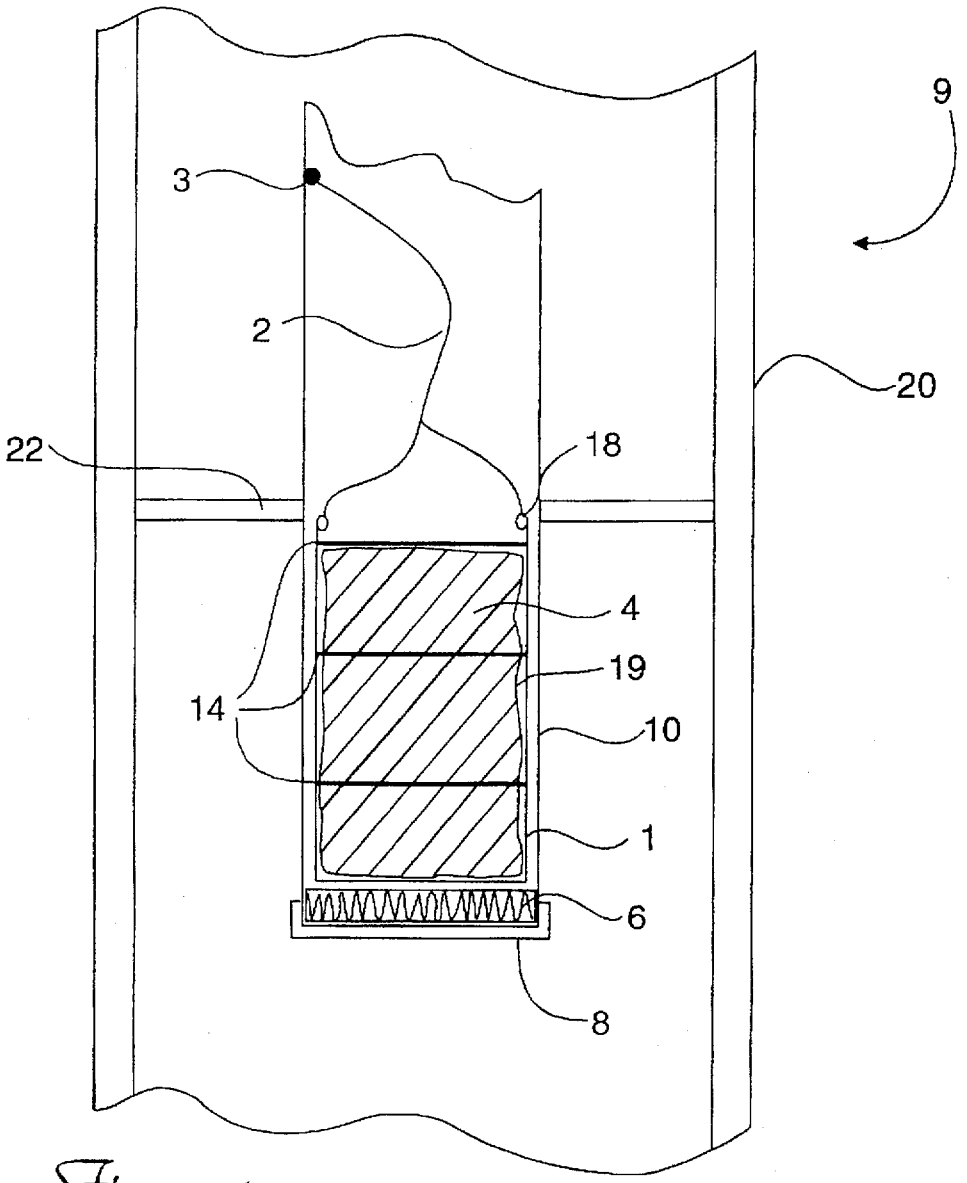
FIG. 1 illustrates a schematic, cut-away, front view of the fire-safety device of the invention.
Figure 2:
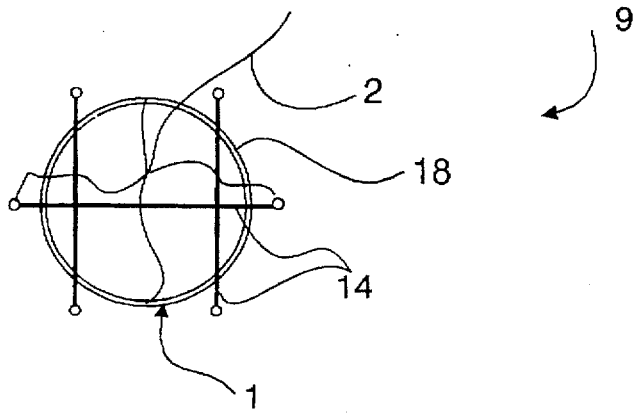
FIG. 2 depicts a top view of the safety device shown in FIG. 1.
Figure 3:
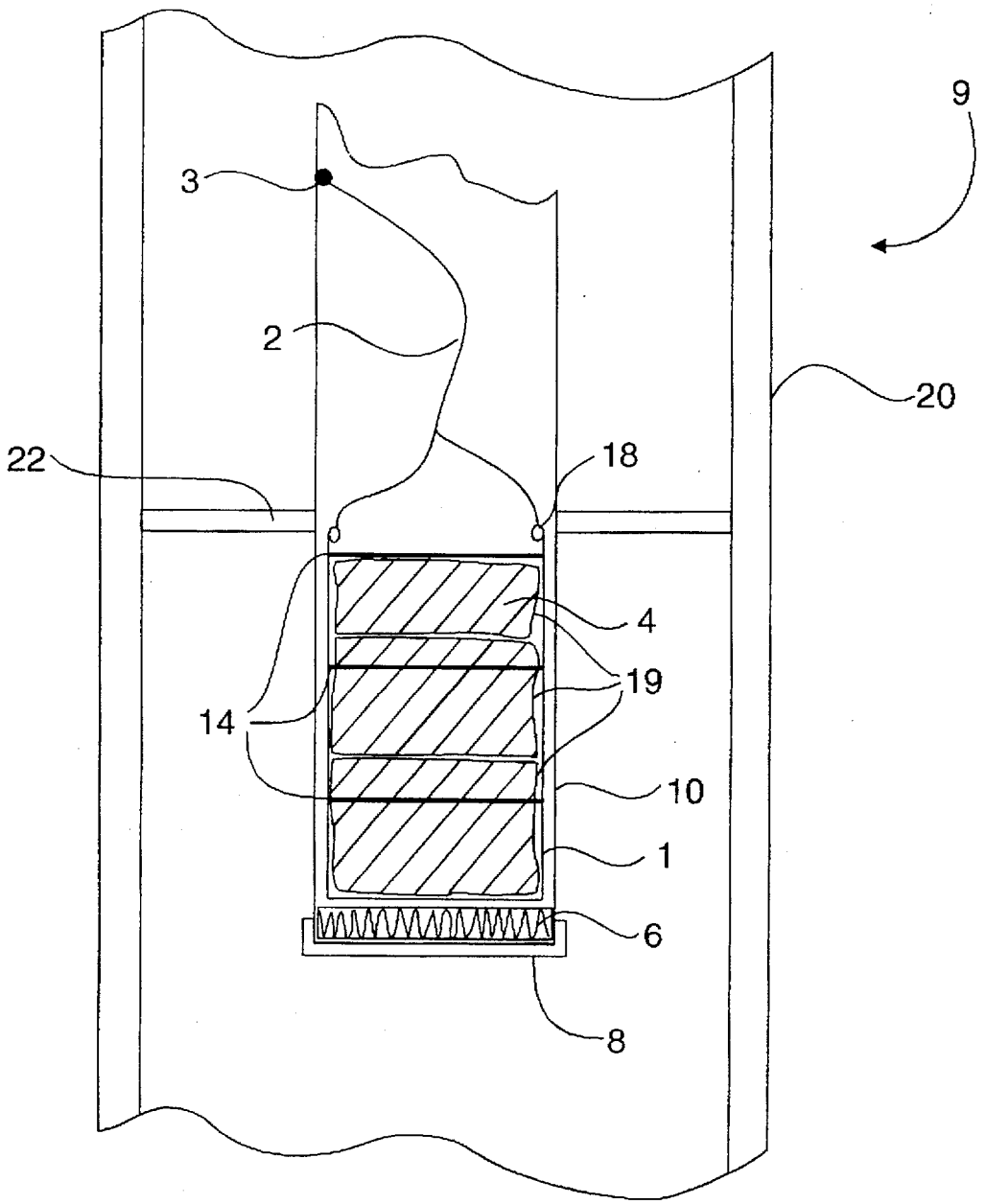
FIG. 3 depicts a schematic, cut-away front view of the fire-safety device showing a plural membrane construction.

Now referring to FIGS. 2, 2 and 3, the fire-safety device 9 of this invention is shown. The device 9 comprises a housing in the form of a cylindrical canister 10 that is affixed within a chimney or flue 20 by suitable fixturing 22. A mounting cord 2 is connected to an adjustable, circular mounting ring 18 and to canister 10 at reference numeral. The cord, which can be moved along the length of canister 10, allows for the setting of preferred temperature release. The canister 10 contains a mass of fire-extinguishing compounds 4 disposed within one or more membrane envelopes 19, as more fully described in the aforementioned U.S. Pat. No. 5,163,516. It should be understood, however, that, without departing from the scope of this invention, envelopes 19 can be eliminated and bulk chemicals used in their place.

The illustrated membrane 19 disposed in canister 10 can be designed to release its contained substances at a desired time, depending upon the disintegration of the membrane material. Several membranes 19 can be used (FIG. 3), so that a steady, progressive, sequential stream of chemicals is fed to the fire. In this manner, each of the chemicals begins operation where the previous chemical left off, extinguishing the fire in a progressive manner, as described in the aforementioned United States patent. The membranes 19 are designed to melt at different given temperatures.

The membranes 19 containing the extinguishing agent 4 rest within a mesh basket 1 which comprises a number of cross-wire members 14, as shown. An insulation platform 6 is suspended within the canister 10 below the basket 1, to prevent the premature melting of membranes 19. The bottom portions of both the basket 1 and the insulation platform 6 rest on the fuse cap 8, which can be made of hightemperature plastic. The fuse cap 8 is in contact with the chimney flue gases; it will disintegrate at the proper flue-gas temperature, i.e., when the fire becomes too hot or reaches a dangerous temperature. The fuse cap 8 is designed to melt or disintegrate at temperatures consistent with fires that are out of control.

Upon the disintegration of the fuse cap 8, the insulation 6 will drop out of the canister 10. The basket 1 holding the extinguishing chemicals 4 will also drop from the canister 10, but will become suspended over the fire because of the tether cord 2. The membranes 19 then come in contact with the flue gases and begin to disintegrate. The extinguishing chemicals 4 then feed the fire. Cable 2 is of a suitable length to cause the basket 1 to become suspended in an upper portion of the flue. The even distribution of the extinguishing agent 4 through the wires 14 of the mesh basket 1 ensures that all of the fire-fighting compounds are fully utilized so as to extinguish the fire. The rate of release of the chemicals through the wires 14 depends upon the fineness or the coarseness of the mesh. A fine mesh releases the chemicals more slowly, whereas a coarse mesh allows for a more rapid flow of extinguishing materials from the basket 1. In this manner, the mesh basket 1 acts like a metering device for adjusting the rate of flow of the extinguishing chemicals, the mesh being in the range of fine (approximately 1½"×1½") to coarse (approximately 2½"×2½"), with 2"×2" being optimal mesh size.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the current invention, what is desired to be protected by Letters Patent is presented by the subsequently appended claims:

What is claimed is:

1. A chimney-fire safety device for attacking a chimney or stovepipe fire that is in a dangerous or runaway fire condition by application of flame-extinguishing compounds, said device comprising:

a) a housing having a bottom portion that is in contact with flue gases, said housing being mountable within a chimney or stovepipe flue, said housing containing a mesh basket filled with said extinguishing compounds, said mesh basket being constructed of a given size of mesh, so as to release said extinguishing compounds onto the fire at a metered rate of feed;

b) tethering means connected between said mesh basket and said housing;

c) a layer of insulation disposed in said bottom portion of said housing for thermally protecting said extinguishing compounds; and d) fusing means disposed in said bottom portion of said housing, and being operative to release said layer of insulation and said mesh basket when said flue gases reach a temperature commensurate with that of the dangerous or runaway-fire condition, whereby said fusing means disintegrates, in which said layer of insulation and said mesh basket drop from said housing, and said mesh basket becomes suspended over said fire in the dangerous or runaway condition due to said tethering means.

2. The chimney-fire safety device in accordance with claim 1, wherein said extinguishing compounds are disposed within at least one envelope.

3. The chimney-fire safety device in accordance with claim 1, wherein said housing comprises a cylindrical canister.

4. The chimney-fire safety device in accordance with claim 1, wherein said mesh basket comprises fine wire mesh of approximately 1½"×1½" for slowly releasing said extinguishing compounds.

5. The chimney-fire safety device in accordance with claim 1, wherein said mesh basket comprises coarse wire mesh of approximately 2½"×2½" for quickly releasing said extinguishing compounds.

6. A chimney-fire safety device for attacking a chimney or stovepipe fire that is in a dangerous or runaway-fire condition by application of time-release flame-extinguishing compounds, said device comprising:

a) a canister having a bottom portion that is in contact with flue gases, said canister being mountable within a chimney or stovepipe flue, said canister containing a mesh basket filled with said time-release extinguishing compounds, said mesh basket comprising a given size of mesh; so as to release said extinguishing compounds onto the fire at a metered rate of feed;

b) tethering means connected between said mesh basket and said canister;

c) a layer of insulation disposed in said bottom portion of said canister for thermally protecting said extinguishing compounds; and d) fusing means disposed in said bottom portion of said canister, and being operative to release said layer of insulation and said mesh basket when said flue gases reach a temperature commensurate with that of the dangerous or runaway-fire condition, whereby said fusing means disintegrates, in which said layer of insulation and said mesh basket drop from said canister, and said mesh basket becomes suspended over said fire in the dangerous or runaway condition due to said tethering means.

7. The chimney-fire safety device in accordance with claim 6, wherein said extinguishing compounds are disposed within a plurality of time-release envelopes designed to progressively release said extinguishing compounds onto said fire in the dangerous or runaway condition.

8. The chimney-fire safety device in accordance with claim 6, wherein said canister has a cylindrical shape.

9. The chimney-fire safety device in accordance with claim 6, wherein said mesh basket comprises fine wire mesh of approximately 1½"×1½" for slowly releasing said extinguishing compounds.

10. The chimney-fire safety device in accordance with claim 6, wherein said mesh basket comprises coarse wire mesh of approximately 2½"×2½" for quickly releasing said extinguishing compounds.

* * * * *